United States Patent [19]

Mirkin

[11] Patent Number: 4,670,174

[45] Date of Patent: Jun. 2, 1987

[54] COLLOID LUBRICANT AND METHOD OF LUBRICATING MUSICAL WIND INSTRUMENTS

[76] Inventor: Jorge Mirkin, 2221 Bloomfield, #31, Cypress, Calif. 90630

[21] Appl. No.: 746,531

[22] Filed: Jun. 19, 1985

[51] Int. Cl.[4] ..... C10M 129/68

[52] U.S. Cl. ..... 252/565; 585/9

[58] Field of Search ..... 585/9; 252/56 S, 56 R, 252/9

[56] References Cited

U.S. PATENT DOCUMENTS

| | | | |
|---|---|---|---|
| 1,559,592 | 11/1925 | Webster | 252/56 R |
| 1,854,237 | 4/1932 | Seeple | 252/56 R |
| 1,920,161 | 7/1933 | Rosen | 252/56 R |
| 2,775,561 | 12/1956 | Frohmader | 585/9 |
| 3,428,565 | 2/1969 | Fischer | 585/9 |
| 3,928,214 | 12/1975 | Naka et al. | 252/58 |

*Primary Examiner*—Jacqueline V. Howard

*Attorney, Agent, or Firm*—Charles H. Thomas

[57] ABSTRACT

A colloid lubricant is provided which has the lubricating characteristics of grease, but which is not sticky like grease. The lubricant is formed of a mixture of wax and oil, preferably paraffin and mineral oil, mixed in approximately equal proportions. The lubricant is particularly useful for lubricating valves in musical wind instruments.

8 Claims, No Drawings

COLLOID LUBRICANT AND METHOD OF LUBRICATING MUSICAL WIND INSTRUMENTS

BACKGROUND OF THE INVENTION

1. Field of the Invention

The present invention relates to lubricants and methods of lubricating valves in musical wind instruments.

2. Description of the Prior Art

Innumerable substances have long been used in a variety of applications to lubricate mechanisms with components that move relative to each other. Grease formed as a petroleum derivative is widely used for lubricating machine parts, valves, and other mechanical devices. Grease possesses the highly desirable lubricating characteristic of low resistance in shear, so that a film of grease between moving parts will facilitate movement of the parts past each other. The use of a film of grease between moving mechanical parts reduces wear on the parts which would otherwise result from friction. Grease does, however, have an undesirable property of stickiness or tackiness. This property is particularly undesirable when grease is used to lubricate moving parts which are brought into contact relative to each other and then separated. The valves in musical wind instruments, such as clarinets, saxophones, and harmonicas are exemplary devces of this type. In such valve mechanisms a valve closure element is repeatedly seated and unseated relative to a valve seat element or slid sideways, as in harmonicas. Where grease is employed as a lubricant the valve closure elements in such instruments will tend to stick to the valve seats, thus degrading the quality of music which can be produced with the instrument.

SUMMARY OF THE INVENTION

The present invention is a novel lubricating mixture which provides the desirable properties of grease as a lubricant, but which avoids the undesirable property of stickiness or tackiness. The lubricating mixture of the invention includes all of the advantages of grease and has some of the advantages of oil as well. Specifically, like grease, the lubricating mixture of the invention does not splash, drip, run-off or dry. Also like grease, the mixture of the invention provides a tough film which lubricates moving mechanical components, even when those components are operated under pressure. Unlike grease, and similar to oil, the lubricating mixture of the invention is not sticky, but instead is very slippery. The lubricating mixture of the invention allows moving surfaces to pass each other with a minimum of friction and wear, yet the lubricating mixture remains stable and will not dry out even when left exposed for a considerable period of time.

In one broad aspect the invention is a lubricating mixture comprising wax and oil mixed in proportions within the range of ratios of between 2:1 and 1:2. In another broad aspect the invention may be considered to be a method of lubricating a musical wind instrument having valve elements, comprising applying to those valve elements a mixture of wax and oil mixed in proportions within the range of ratios of between 2:1 and 1:1.

The lubricant of the invention and the method of lubricating valves in musical wind instruments is based upon a physical phenomenon not previously recognized. Specifically, when the novel lubricant mixture of wax and oil is produced, the resultant mixture has unexpected physical properties which differ from the properties of the separate components. Specifically, the wax does not dissolve within the oil, but rather the wax and oil form a cohesive, colloidal slush, the molecules of which tend to cohere together, without forming molecular links. The mixture of the invention acts like molecular ball bearings so that a film of the mixture shears readily, but does not make the surfaces to which it is applied sticky.

Preferably, the oil and wax of the lubricating mixture are mixed in about equal proportions. The proportions may be varied to the extent of up to about two parts of one component for each part of the other. Beyond this range undesirable properties are produced. If the ratio of wax to oil becomes greater than two to one, the mixture will not form a cohesive slush, but rather will crumble. Conversely, if the ratio of oil to wax becomes greater than two to one, the mixture becomes too thin to provide good lubricating properties.

The lubricating mixture of the invention may be advantageously employed to replace grease in all applictions in which grease is used as a lubricant. It also has the advantages of oil of cleanliness and long lasting lubrication. The lubricating mixture of the invention may be used in place of oil where there is easy access to the surfaces being lubricated.

One particularly advantageous application of the lubricating mixture of the invention is in lubricating the valve elements of musical wind instruments. The lubricating mixture may be applied to the valves of harmonicas, clarinets, saxophones, trombones and other musical wind instruments.

In conventional practice, most musicians prefer to avoid the use of lubricants altogether, since no suitable lubricant has heretofore been available for use with instruments. Without a lubricant it is necessary for the valves of the wind instruments to be frequently disassembled and cleaned, as they will tend to stick due to moisture in a musician's breath after only a brief period of use without cleaning. The valves tend to stick to the valve pads, thus degrading the quality of the sound produced by the wind instrument. The lubricating mixture of the invention has particular applicability to woodwinds, as the properties of the mixture do not harm the wood, metal or plastic in any way. The lubricant of the invention may be utilized as a cork lubricant as well. A clarinet, for example, is formed with a series of tubular sections which fit one within another. A band of cork typically encircles each tubular section at the insertion end. The cork bands reside in contact to form accoustical seals at the mating interfaces of the tubular sections. However, if the cork hardens and dries, the accoustic seal can become broken and the quality of sound produced is degraded.

The lubricant of the invention preserves the cork in wind instruments and prevents the cork from drying out. Also, the lubricant ensures accoustic seals of long life between the mating tubular sections.

The most economical wax is paraffin, such as is conventionally used in the manufacture of candles. However, either beeswax or carnauba may be employed in place of paraffin, but both are more expensive than paraffin.

Virtually any type of oil may be employed in the invention, although mineral oil is best because it doesn't spoil. Among the oils which may be used in the formulation of the lubricating mixture of the invention are light mineral oil (such as baby oil), motor oil, diesel fuel, heavy machine oil, kerosene, and so forth. Vegetable oil and animal fat may also be used, but require preservatives and are usually more expensive. Salad oil may also be employed in the lubricating mixture of the invention.

The lubricating mixture of the invention may also contain small amounts of other ingredients in addition to the wax and oil. For example, a small amount of rubbing alcohol or some other light alcohol can be used to improve the smell of the mixture when oils having disagreeable odors are utilized. Common rubbing alcohol (isopropyl alcohol) also serves as a preservative and does not effect the desirable properties of the lubricant of the invention. Small amounts of conventional coloring additives may also be employed.

The most desirable ratio of mixture of wax and oil in the lubricating mixture of the invention is 1:1. The quantity of either substance may be increased up to twice the amount of the other for special purposes. However, if the ratio of either the wax or oil to the other major component exceeds 2:1, the mixture begins to lose its practical value to a point where one of the main ingredients becomes a mere additive to the other and the desired physical slush is no longer achieved.

One suitable formulation of the mixture of the invention may be produced in the following manner.

EXAMPLE

One-hundred grams of paraffin are melted over low heat, and 100 grams of mineral oil are slowly added. The heat is then removed. As the mixture starts to cool, it becomes cloudy. At this time the mixture is preferably agitated thoroughly, as by light beating with a spoon, until it becomes opaque. Agitation is not indispensible, but does promote the formation of a slush so that the lubricating mixture is more easily dispensed, both for packaging and for use. An absence of agitation during the cooling stage results in a mixture having a harder texture. However, such a mixture within the proper ratio range will quickly turn into a slush once it is used between moving parts. For use, the mixture may be dispensed and packaged as a paste, or sprayed in a carrier as an aerosol.

The lubricating mixture of the invention has all of the advantages of convenional grease lubricants. That is, if forms a tough film, does not dry out, and will not drip. Moreover, the lubricant mixture will run easily, and most importantly, does not have the property of stickiness. The freezing temperature and the shear qualities of the slush are the same as the oil from which the mixture is produced.

The lubricating mixture of the invention is non-toxic and will not stain. It may easily be washed from skin, and from fabrics with warm water and detergent.

As previously noted, the lubricating mixture of the invention may be employed in all instances as a substitute for grease lubricants. That is, the lubricating mixture will provide exceptional performance as a lubricant in high speed devices, such as in ball bearings, distributor rotors, motorcycle and bicycle chains, and in other applications. The lubricating mixture has special purpose application as a woodwind pad cream and woodwind valve lubricant, and as a harmonica lubricant. When used as a lubricant in musical wind instruments, the lubricating mixture ensures that the valve elements move with a nimble action. Also, the lubricating mixture will not drip when employed as a lubricant in a musical wind instrument.

To use the lubricating mixture of the invention to lubricate flap or slide valves, a piece of paper is first saturated with the lubricating mixture, so that a film of lubricating mixture exists on one side of the paper. The paper is then placed between each valve closure element and the pad upon which that closure element seats, and is then pulled from between the valve element and the pad. This process is repeated several times with each valve to ensure the deposit of a thin film of the lubricant mixture on both the valve and the pad to protect and improve the seal by filling the pores in the pad. The lubricant mixture will thereafter prevent the valve closure elements and the pads from becoming sticky. If the valve elements are already sticky, application of the lubricant mixture in the forgoing manner will significantly reduce the stickiness.

Undoubtedly, numerous variations and modifications of the invention will become readily apparent to those familiar with lubricants and with the lubrication of musical wind instruments. Accordingly, the scope of the invention should not be construed as limited to the specific formulations and applications of the lubricating mixture described, but rather is defined in the claims appended hereto.

I claim:

1. In a substance for lubricating musical wind instruments the improvement comprising a mixture consisting essentially of wax selected from the group consisting of paraffin, carnuba and beeswax and oil mixed in proportions within the range of ratios of between 2:1 and 1:2.

2. A lubricating mixture according to claim 1 in which said oil is selected from the group consisting of mineral oil, motor oil, diesel oil, kerosene, vegatable oil, animal fat and salad oil.

3. A lubricating mixture according to claim 1 in which said wax is paraffin and said oil is mineral oil.

4. A lubricating mixture according to claim 3 in which said wax and oil are mixed in about equal proportions.

5. A method of lubricating a musical wind instrument having valve elements comprising applying to said valve elements a mixture consisting essentially of wax selected from group consisting of paraffin, carnuba and beeswax and oil mixed in proportions within the range of ratios of between 2:1 and 1:2.

6. A method according to claim 5 in which said oil is selected from the group consisting of mineral oil, motor oil, diesel oil, kerosene, vegatable oil, animal fat and salad oil.

7. A method according to claim 5 in which said wax is paraffin and said oil is mineral oil.

8. A method according to claim 7 in which said wax and oil are mixed in about equal proportions.

* * * * *